US006973888B2

(12) United States Patent
Yoshikazu

(10) Patent No.: US 6,973,888 B2
(45) Date of Patent: Dec. 13, 2005

(54) SEWING MACHINE AND A NEEDLE THREADING DEVICE THEREOF

(75) Inventor: Ebata Yoshikazu, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 0 days.

(21) Appl. No.: 10/889,905

(22) Filed: Jul. 13, 2004

(65) Prior Publication Data

US 2005/0022709 A1 Feb. 3, 2005

(30) Foreign Application Priority Data

Jul. 31, 2003 (JP) ..... 2003-284107

(51) Int. Cl.[7] ..... D05B 87/02
(52) U.S. Cl. ..... 112/225
(58) Field of Search ..... 112/225, 302, 253, 112/221; 223/99

(56) References Cited

U.S. PATENT DOCUMENTS

| | | | | |
|---|---|---|---|---|
| 5,143,005 | A * | 9/1992 | Jimenez et al. | 112/225 |
| 5,615,629 | A * | 4/1997 | Yamada et al. | 112/225 |
| 6,564,731 | B2 * | 5/2003 | Sano et al. | 112/225 |
| 6,655,306 | B2 * | 12/2003 | Kotaki | 112/225 |
| 6,814,016 | B2 * | 11/2004 | Hori | 112/225 |

* cited by examiner

*Primary Examiner*—Ismael Izaguirre
(74) *Attorney, Agent, or Firm*—Nields & Lemack

(57) ABSTRACT

A needle threading device of a sewing machine, wherein an operating lever is manually operated to move down against spring action until a threading hook secured to the lower end of a threading bar comes to a position where there is an eye of machine needle. The threading bar is then axially rotated. With the axial rotation of the threading bar, the threading hook is rotated to pass through the needle eye. With release of the operating lever from the manual operation, the threading bar is moved up by spring action while the threading hook catches an upper thread of the sewing machine and is pulled out of the needle eye.

11 Claims, 8 Drawing Sheets

SEWING MACHINE AND A NEEDLE THREADING DEVICE THEREOF

BACKGROUND OF THE INVENTION

1. Field of the Invention

The present invention relates to a sewing machine and a needle threading device mounted to a sewing machine.

2. Related Art

So far, many inventions have been made in connection with a device for threading a needle of sewing machine. For example, the Japanese patent laid open 2003-38886 discloses a needle threading device of a sewing machine wherein a threading bar is moved down in association with operation of a threading lever, and is stopped at a position where the eye of machine needle is located.

As the threading lever is further pressed down, the threading bar is rotated by means of a cam which is so formed to rotate the threading bar. Then a hook is inserted into the eye of needle from the rear side to the front side of the needle. The operator hangs the upper thread to the hook and releases or moves up the threading lever. Then the hook is moved back as the threading bar is moved up and the upper thread is pulled to pass through the needle eye. Thus the threading operation is finished.

OBJECT OF THE INVENTION

However the conventional threading devices require the machine operator to pay a special attention for guiding the upper thread to hang it to the hook. Further the machine operator is required to hold the upper thread as is hanged to the hook until the hook is moved back and the threading bar is moved up. Otherwise, the upper thread may slip out from the hook. Namely the machine operator of little experience will often fail to thread the machine needle. It is, therefore, an object of the invention to eliminate the defects and inconveniences of the prior art and to provide a threading device wherein the upper thread may be guided to the hook without requirement of the machine user to hold the upper thread, and the upper thread may be securely held in a pocket of the hook before the hook is moved back and slipped out from the needle eye.

SUMMARY OF THE INVENTION

The sewing machine of the invention is provided with a needle having a needle eye formed at the lower end thereof, a threading hook which may be inserted or passed through the needle eye and may catch an upper thread of sewing machine which is brought to engage the threading hook, a hook inserting means for inserting the threading hook through the needle eye and for pulling the threading hook out of the needle eye, a thread holding means for holding the upper thread with a tension applied thereto, a thread moving means which is operated in association with the hook inserting means to move the upper thread held by the thread holding means to a position where the upper thread may be caught by the threading hook which is inserted through the needle eye, the threading hook being pulled back from the needle eye to pass the upper thread through the needle eye.

The thread moving means is operated to move the upper thread in a manner that the upper thread is caught by the threading hook which is inserted through the needle eye and is pulled back from the needle eye. In a preferred embodiment, the upper thread is brought to a position where the upper thread is caught by the threading hook when the threading hook is retreated from the needle eye.

It is preferable that the threading hook, the hook inserting means, the thread holding means and the thread moving means are normally maintained in a vertically higher position with respect to the machine needle and are moved down as is necessary. In the structure, the thread holding means and the thread moving means are moved up and down with the threading hook in association with operation of the hook inserting means.

It is preferable that the upper thread to be passed through the needle eye is attached to the thread holding means by the machine operator when the latter is in a lower position with respect to the machine needle.

In a preferred embodiment, the thread holding means holds the upper thread on the side of machine needle where the threading hook is protruded through toward the machine operator such that the upper thread may be moved up along the needle to a position where the upper thread is caught by the threading hook as the thread holding means is moved up by the thread moving means. The threading hook is typically of a shape of horizontally extending shank having a downwardly extending thread catching hook, the hook being pulled back from the needle eye as the upper thread is moved up along the needle in contact therewith to a position where the upper thread is caught by the hook. The threading operation is finished when the threading hook is pulled back because the upper thread is caught by the threading hook and is passed through the needle eye together with the threading hook.

In a preferred embodiment, the thread inserting means, the threading hook and the thread holding means are normally urged in the upper direction by spring action and are normally held in an upper inoperative position. The thread inserting means is manually operated against spring action to move down the threading hook and the thread holding means to a lower operative position where the threading hook is inserted through the eye of machine needle and the thread holding means moves the upper thread to a position where the upper thread is caught by the threading hook.

Subsequently when the thread inserting means is released from manual operation, the thread inserting means is moved up by spring action while the threading hook is pulled back from the needle eye catching the upper thread held by the thread holding means.

The thread moving means includes a mechanism for jumping up the thread holding means to a position where the upper thread is caught by the threading hook as the latter is pulled back from the needle eye.

Typically the threading hook is supported by a threading member which is moved down as the thread inserting means is moved down from an upper inoperative position to a lower operative position where the threading member is rotated in a manner that the threading hook is passed through the eye of machine needle. Subsequently the threading means is released and returned to the upper inoperative position by spring action while the threading member is rotated back and the threading hook is accordingly pulled back from the needle eye and is returned to the upper inoperative position.

Figure 1:
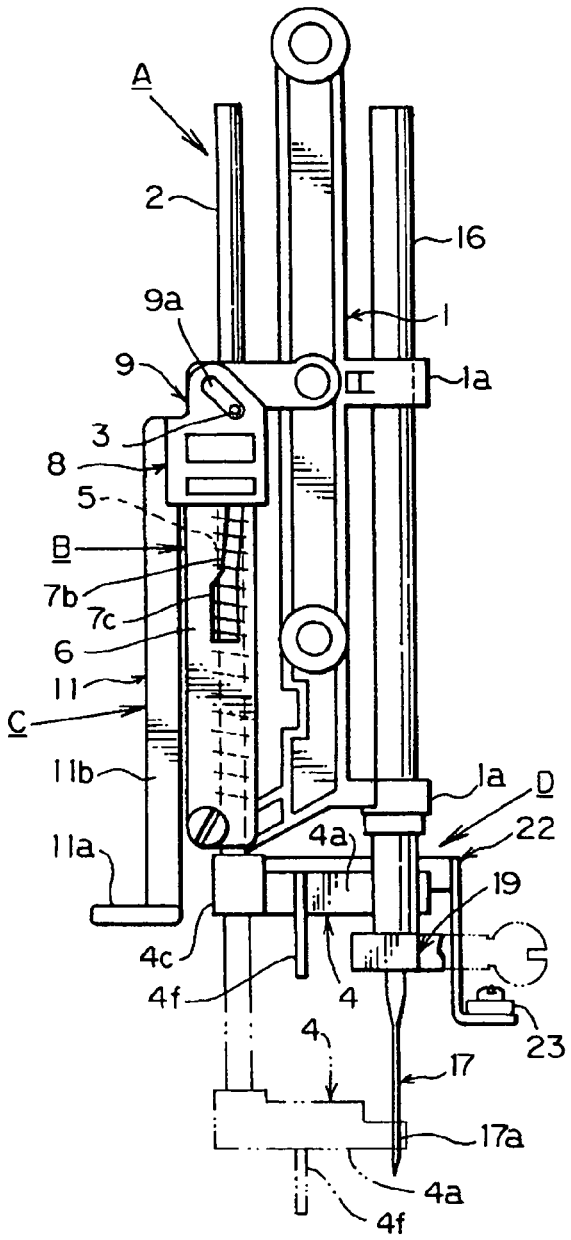
FIG. 1
Figure 1:
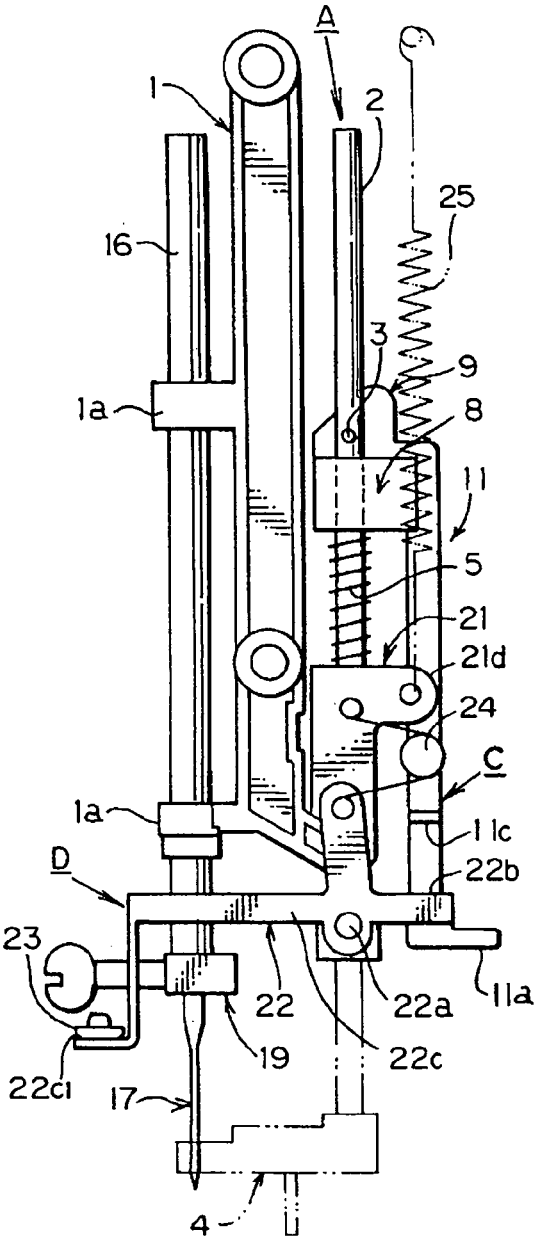

(*a*) is a front elevational view of a threading device of the invention showing the structure thereof.

(*b*) is a rear side view of the threading device.

FIG. 2

(*a*) is a perspective view of the threading device shown as located at a lower position.

(*b*) is an exploded view of the threading device.

FIG. 3

(*a*) is a perspective view of the essential part of the threading device.

(*b*) is the rear side view of the essential part of the threading device.

FIG. 4

(*a*) is a side elevational view of the essential part of threading device showing an auxiliary mechanism for holding the upper thread to be threaded.

(*b*) is a perspective view of the auxiliary mechanism for holding the upper thread to be threaded.

(*c*) is an exploded view of the auxiliary mechanism for holding the upper thread to be threaded.

FIG. 5

(*a*) is a front elevational view of the auxiliary mechanism for holding the upper thread shown as located at an upper position relative to a machine needle.

(*b*) is a perspective view of the auxiliary mechanism for holding the upper thread shown as located at a lower position relative to the machine needle.

(*c*) is a front elevational view of the auxiliary mechanism for holding the upper thread shown as located at the lower position relative to the machine needle.

(*d*) is a plan elevational view of the auxiliary mechanism shown in lateral section as located at the lower position relative to the machine needle.

FIG. 6

(*a*) is a perspective view of the auxiliary mechanism for holding the upper thread shown as located at the lower position relative to the machine needle with a threading hook being inserted through the eye of machine needle.

(*b*) is a plan elevational view of the auxiliary mechanism for holding the upper thread shown in lateral section as located at a lower position relative to the machine needle with the threading hook being inserted through the eye of machine needle.

(*c*) is a side elevational view of the auxiliary mechanism for holding the upper thread shown in vertical section as located at the lower position relative to the machine needle with the threading hook being inserted through the eye of machine needle.

FIG. 7

(*a*) is a perspective view of the auxiliary mechanism for holding the upper thread shown as located at the lower position relative to the machine needle with the threading hook being inserted through the eye of machine needle.

(*b*) is a front elevational view of the auxiliary mechanism for holding the upper thread shown as located at the lower position relative to the machine needle with the threading hook being inserted through the eye of machine needle.

(*c*) is a plan elevational view of the auxiliary mechanism for holding the upper thread shown in lateral section as located at the lower position relative to the machine needle with the threading hook being inserted through the eye of machine needle.

(*d*) is a side elevational view of the threading hook shown in vertical section as inserted through the eye of machine needle with the upper thread being moved to hang to the threading hook.

FIG. 8

(*a*) is a perspective view of the auxiliary mechanism for holding the upper thread shown as having inserted the upper thread through the eye of machine needle.

(*b*) is a plan elevational view of the auxiliary mechanism for holding the upper thread shown in lateral section as having inserted the upper thread through the eye of machine needle.

DETAILED DESCRIPTION OF THE PREFERRED EMBODIMENTS

The invention will now be described in reference to preferred embodiments as shown in the attached drawings. As particularly shown in FIGS. 1 and 2, The invention is substantially composed of a threading shaft member A, a fixed guide member B, an operating member C, a thread holding member D and so on. These members A, B and C are mounted on a needle bar holder 1. The needle bar holder 1 is swingingly movable in a machine arm (not shown) and holds a needle bar 16 by means of upper and lower supports 1*a*, 1*a* such that the needle bar may be vertically reciprocated and may swing with the needle bar holder 1 laterally of the cloth feeding direction.

Figure 2:
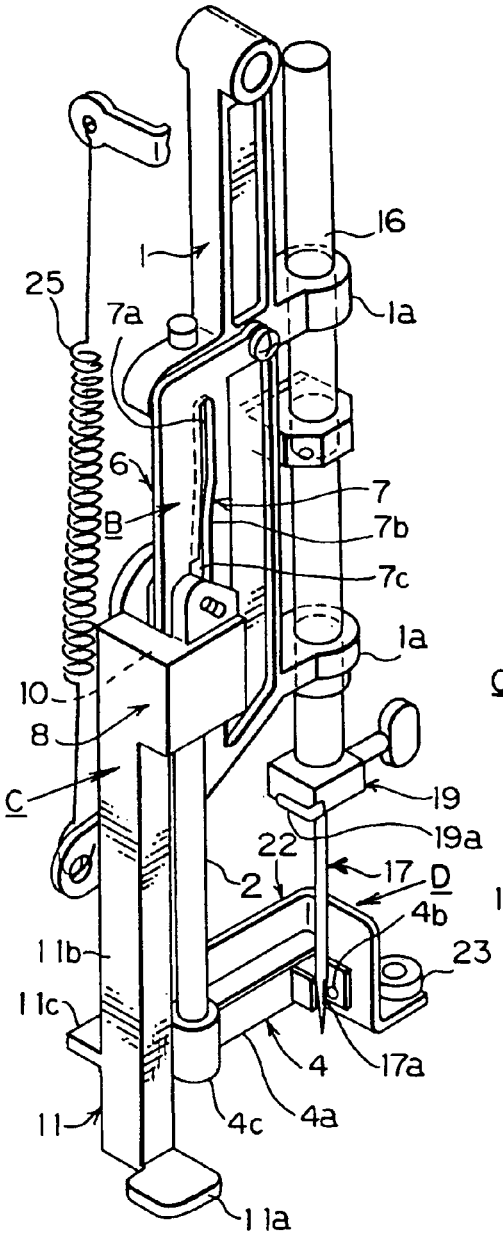
Figure 2:
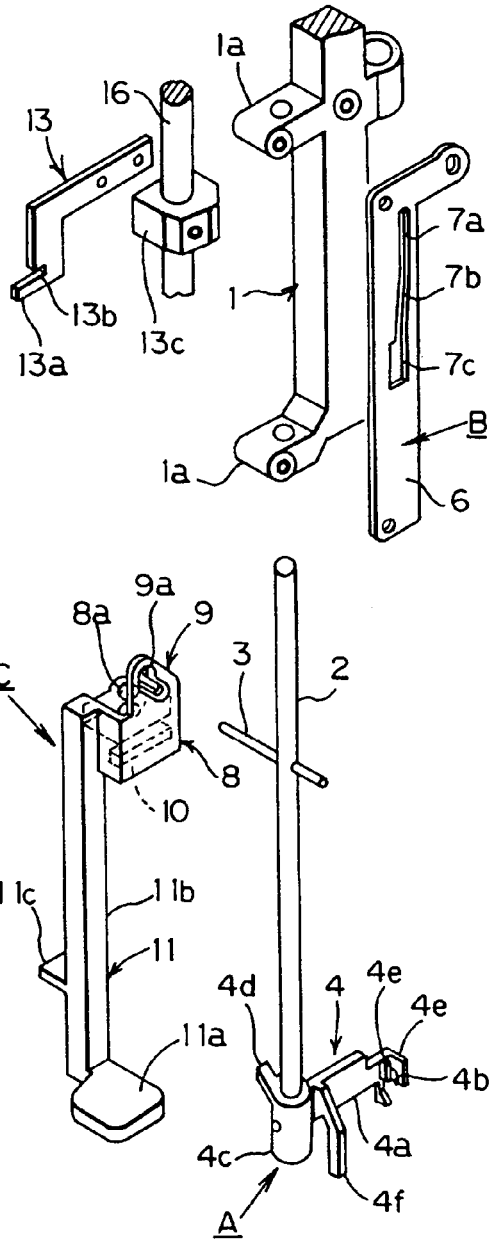

As shown in FIG. 2(*b*), the threading shaft member A includes a threading bar 2, a guide pin 3 and a threading member 4. The guide pin 3 is arranged normal to the threading bar 2 as laterally extending therethrough with both ends protruded at an upper part about ⅓ of the entire length of the threading bar 2. The guide pin 3 is operated by way of the operating member C and a guide member 9 to vertically move the threading bar 2 as will be described in detail hereinlater.

As shown in FIG. 2(*b*), the threading member 4 includes an arm 4*a*, a threading hook 4*b*, a hollow cylindrical part 4*c* and a protrusion 4*d*. The threading member 4 is secured to the lower end of the threading bar 2 by means of the hollow cylindrical part 4*c* with a pin or the like diametrically inserted into the hollow cylindrical part 4*c* and into the threading bar 2 which is axially inserted into the hollow cylindrical part 4*c*. such that the threading member 4 may be rotated as the threading bar 2 is rotated. The protrusion 4*d* is formed as a part of the hollow cylindrical part 4*c* and is operated to move the thread holding member D up and down as will be described in detail hereinlater.

The threading hook 4*b* is arranged at one end part of the arm 4*a* and is opposite to the hollow cylindrical part 4*c* which is arranged at the other end of the arm 4*a*. The threading hook 4*b* is of a size which may freely pass through an eye 17 of a machine needle 17 which is attached to the lower end of a needle bar 16 as will be described in detail hereinlater. The arm 4*a* has a pair of spaced guides 4*e*, 4*e* provided therewith on both sides of the threading hook 4*b* such that the guides 4*e*, 4*e* may engage the opposite edges of the machine needle 17 as the arm 4*a* is moved toward the needle 17. Further the threading member 4 has a thread anchor 4*f* formed therewith adjacent the hollow cylindrical part 4*c* for anchoring and guiding the upper thread as will be described in detail hereinlater in reference to FIGS. 5 through 8.

The guide pin 3 and the arm 4*a* of the threading member 4 are arranged with a predetermined angle provided therebetween. The angle is determined by the rotation angle of the threading bar 2 which is axially rotated by cooperation between the guide pin 3 and a guide groove 7 of the fixed guide member B as will be described in detail hereinlater. The threading bar 2 is normally urged in the upper direction by a coil spring 5 which is provided around the threading bar 2 between the guide pin 3 and the lower support 1*a* of the needle bar holder 1. Namely the threading member 4 secured to the lower end of the threading bar 2 is normally located at an upper position.

As particularly shown in FIG. 1(*a*) and FIG. 2(*b*), the fixed guide member B is mounted to the needle bar holder 1. The fixed guide member B includes a fixed plate 6 having the guide groove 7 formed thereat which is in engagement with the guide pin 3. The guide groove 7 has a first region for vertically guiding the threading bar 2 by means of the guide pin 3 and a second region for axially rotating the threading bar 2 by means of the guide pin 3. Precisely the guide groove 7 includes an upper straight region 7*a* for vertically moving the threading bar 2 while the threading bar 2 is not axially rotated, the next slightly inclined region 7*b* for vertically moving the threading bar 2 while the threading bar 2 is axially rotated and the lowest set groove region 7*c*.

The inclined region 7*b* of the guide groove 7 is so formed as to enable the threading hook 4*b* to avoid the parts of sewing machine while the hook is moved down in threading operation. The set groove region 7*c* is the second region in which the guide pin 3 is positioned to rotate the threading member 4 to a predetermined position. Thus the guide groove 7 is so formed as to guide the guide pin 3 such that the threading hook 4*b* of the threading member 4 may move toward the eye 17*a* of the machine needle 17 attached to the lower end of the needle bar 16. Namely the threading bar 2 begins to axially rotate when the guide pin 3 comes to engage the inclined groove region 7*b*, and when the guide pin 3 comes to engage the set groove region 7*c*, the threading bar 2 is further rotated to pass the threading hook 4*b* through the needle eye 17*a*.

The inclined groove region 7*b* rotates the guide pin 3 axially of the threading bar 2 as the guide pin 3 is moved down along the inclined groove region 7*b*. The threading bar 2 and the arm 4*a* of the threading member 4 are rotated accordingly. The set groove region 7*c* is continuous from the inclined region 7*b* in the lower direction and is opened toward the inclined direction.

As shown in FIG. 2(*b*), the needle bar 16 has a positioning member 13 secured thereto. The positioning member 13 engages guide pin 3 when the threading member 4 comes to the position opposite to the eye 17*a* of machine needle 17, and stops the downward movement of the threading bar 2 and then axially rotates the threading bar 2. The positioning member 13 includes a vertically extended plate having a laterally extended stopper projection 13*a* formed at the lower end thereof, the stopper projection 13*a* having a cutout 13*b* formed thereat for receiving the guide pin 3, and further includes a connecting member 13*c* for connecting the positioning member 13 to the needle bar 16. The stopper projection 13*a* has an upper side formed generally horizontal and extended into the cutout 13*b*.

The stopper projection 13*a* and the cutout 13*b* of the positioning member 13 determine the position where the threading hook 4*b* may pass through the needle eye 17*a* while preventing the vertical movement of the guide pin 3, thereby to prevent the damage of the threading hook 4*b* and the machine needle 17. The connecting member 13*c* of the positioning member 13 is secured to the needle bar 16 at an appropriate position by means of a screw or the like such that the guide pin 3 may be stopped in accordance with variation of the height of the needle eye 17*a*.

The operating member C is provided so as to be vertically moved relative to the fixed guide member B. The operating member C includes a movable base 8, a movable guide 9 formed with a guide groove portion 10 and further includes an operating lever 11. The movable base 8 is formed with a vertical hole 8*a* through which the threading bar 2 is inserted in a manner that the movable base 8 is supported by the threading bar 2.

As shown in FIGS. 1 and 2, the operating member C has the movable base 8 and the movable guide 9 formed in one body with the guide groove portion 10 formed between the movable base 8 and the movable guide 9. The guide groove portion 10 is placed in engagement with the fixed guide plate 6 of the fixed guide member B so as to guide the vertical movement of the operating member C. The movable base 8 is connected to the threading shaft member A with the threading bar 2 being inserted through the vertical hole 8*a* of the movable base 8. The coil spring 5 is mounted around the threading bar 2 between the underside of the movable base 8 and the lower needle bar support 1*a* such that the movable base 8 is normally urged in the upward direction by the coil spring 5.

As shown in FIGS. 1 and 2, the movable guide 9 has a slot 9*a* formed thereat. The slot 9*a* receives the guide pin 3 so as to vertically move guide pin 3 and the threading bar 2 accordingly as the operating member C is vertically moved. The slot 9*a* is inclined at an appropriate angle, generally 45°, but not strictly limited to the mentioned angle. The slot 9*a* is inclined in the direction opposite to the inclined groove region 7*b* of the guide groove 7.

The inclined slot 9*a* is so inclined to give a desired rotation speed of the guide pin 3 as the inclined slot 9*a* moves along the inclined groove region 7*b* of the guide groove 7. In case the inclination of the inclined slot 9*a* is acute, the rotation speed of the guide pin 3 is fast and in case the inclination of the inclined slot 9*a* is obtuse, the rotation speed of the guide pin 3 is slow. Namely the rotation speed of the threading bar 2 and of the arm 4*a* of the threading member 4 is determined by the degree of inclination of the slot 9*a*. The slot 9*a* may be formed as generally extending horizontal. In this case, the rotation speed of the guide pin 3 is fastest.

The operating lever 11 includes a trunk 11*b* having a knob 11*a* formed at the lower end of thereof. The trunk 11*b* is extended vertically from the movable base 8 and is formed with a projection 11*c* laterally extended therefrom. The knob 11*a* may be pressed down with a finger of machine operator against the force of the coil spring 5 to move down the threading shaft member A. The operating member C is mounted to the fixed guide member B with the groove portion 10 being placed in engagement with the guide plate 6 of the fixed guide member B.

Figure 3A:
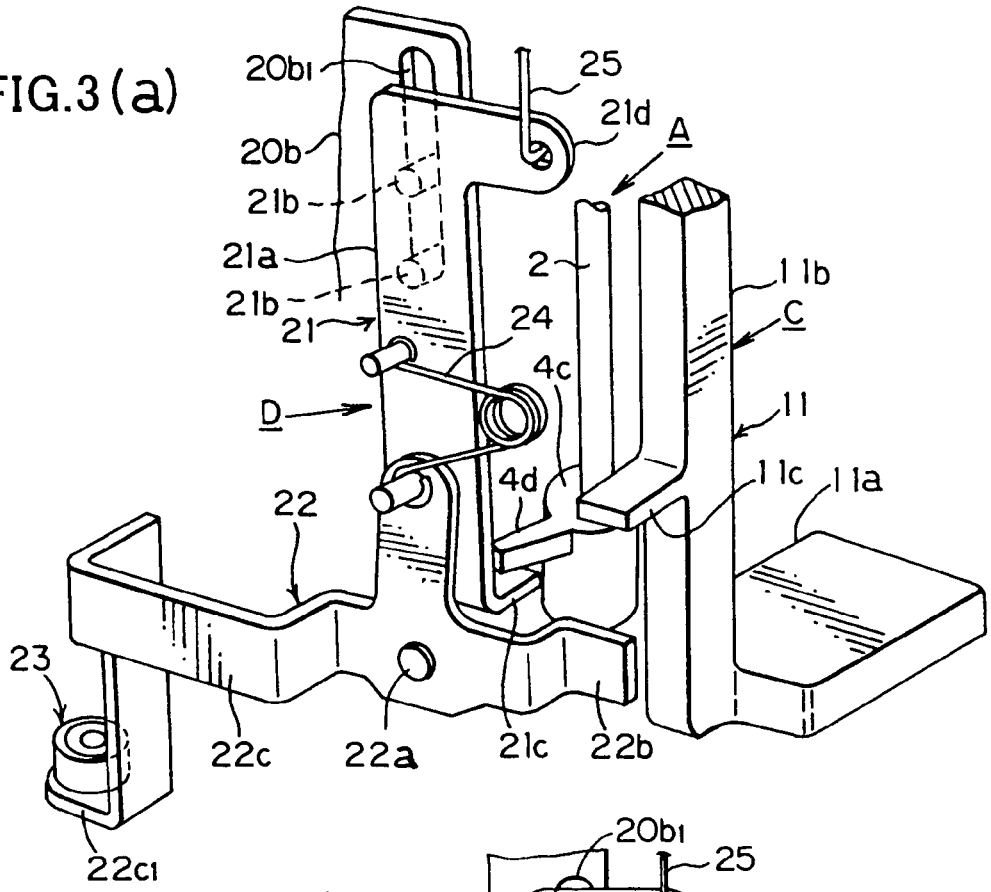
Figure 3B:
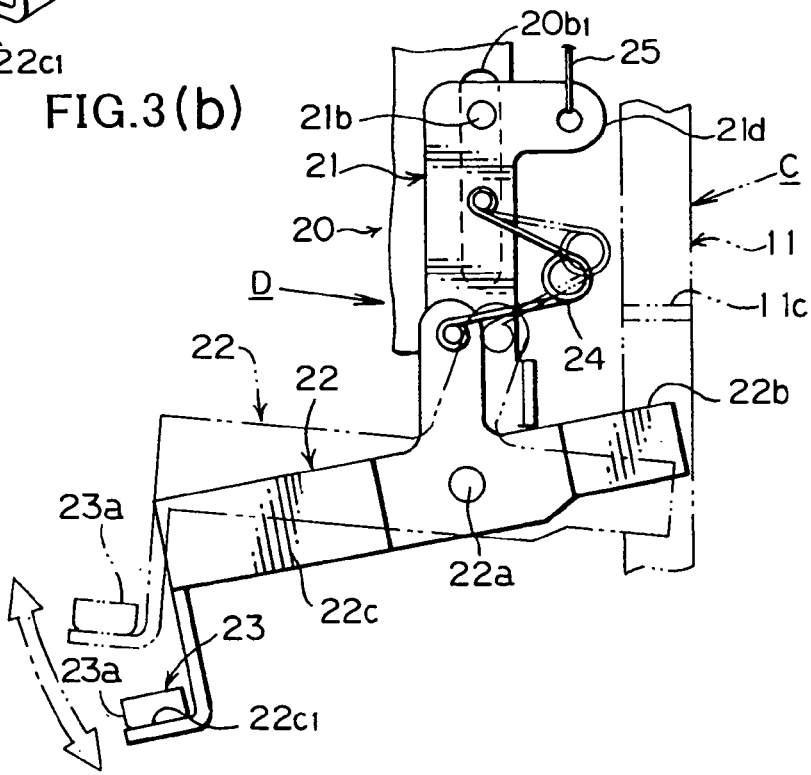
Figure 4:
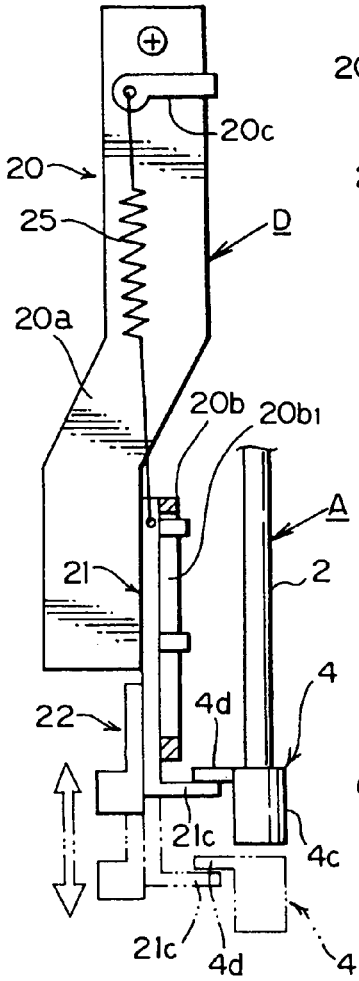
Figure 4:
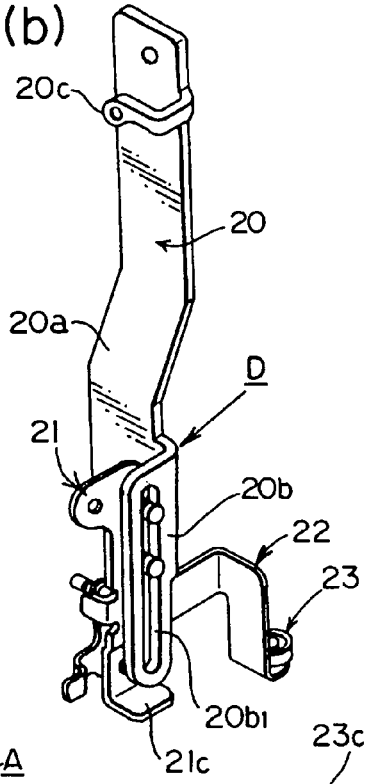
Figure 4:
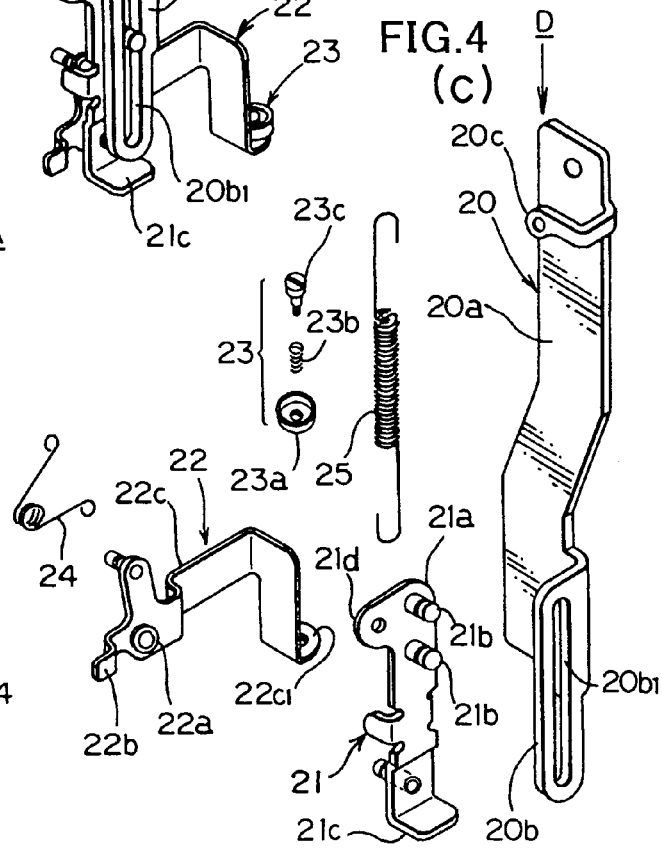

As shown in FIGS. 3 and 4, the thread holding member D includes a base 20 that is a base plate 20*a*, a movable plate 21, a thread holder 22 having a thread holding part 23. The base plate 20*a* is secured to the sewing machine arm (not shown). The base plate 20*a* has a lower part 20*b* bent generally normal to the base plate 20*a*. The lower part 20*b* has a vertical guide groove $\mathbf{20}b_1$ formed thereat. The movable plate 21 is arranged in engagement with the vertical guide groove $\mathbf{20}b_1$ such that the movable plate 21 may be vertically movable relative to the base plate 20*a*. Further the base plate 20*a* has an arm 20*c* formed at the upper part thereof to which the upper end of a tension spring 25 is anchored.

The movable plate 21 includes a body 21*a* having a pair of pins 21*b*, 21*ba* which are inserted into the vertical groove $\mathbf{20}b_1$ of the base plate 20*a* such that the movable plate 21 may be vertically moved as guided by the vertical groove $\mathbf{20}b_1$. The movable plate 21 is bent at the lower end thereof to provide a horizontally flat surface 21*c* which is to be pressed down by the protrusion 4*d* of the threading member 4 such that the movable plate 21 may be moved down. The movable plate 21 has an upper part 21*d* for anchoring the lower end of the tension spring 25. Thus the movable plate 21 is normally urged in the upper direction by the tension spring 25.

The thread holder 22 has a pivot hole 22*a* by which the thread holder 22 is pivotally mounted to the movable plate 21. The thread holder 22 has one end bent to be an engaging part 22*b* which is to be pressed down by the lateral projection 11*c* of the operating lever 11 on one side of the pivot hole 22*a*. Further the thread holder 22 has an arm 22*c* on the other side of the pivot hole 22*a*, the arm 22*c* having a thread holding assembly 23 arranged on the free end $22c_1$ thereof. The thread holding assembly 23 includes a dish-shaped thread presser 23*a* which is mounted on the free end $22c_1$ of the arm 22*c* by a screw 23*c* with a coil spring 23*b* intervened therebetween. As a means for changing the position of the thread holder 22, a toggle spring 24 is arranged between the movable plate 21 and the thread holder 22 such that the thread holder 22 may swing around the pivot 22*a* between a lower position as shown with solid line and a upper position shown with imaginary line as shown in FIG. 3(*b*). The toggle spring 24 is shown as one of the examples which may be used.

With the combination of the constituent elements as mentioned above, the threading operation will now be described in reference to FIGS. 5 through 8.

Figure 5:
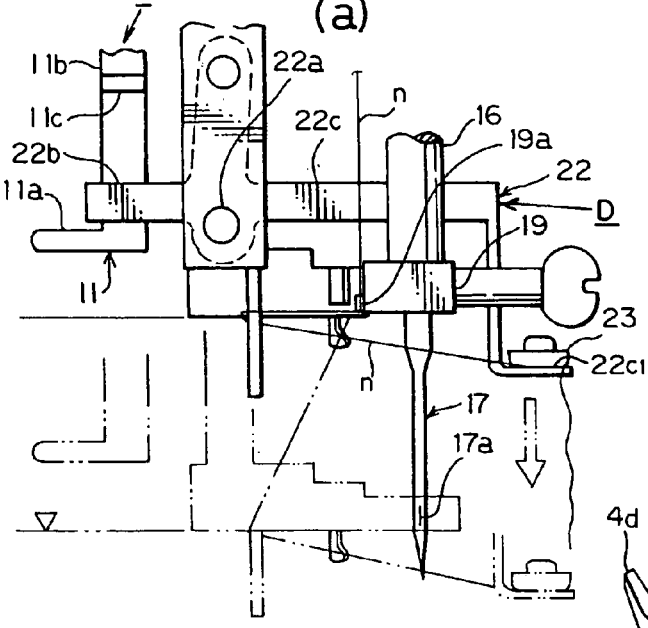
Figure 5B:
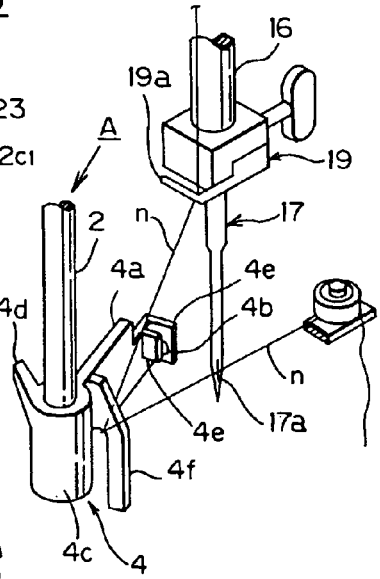
Figure 5C:
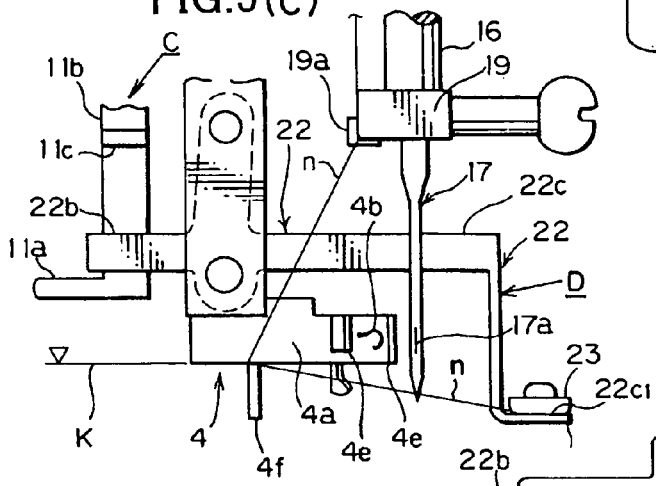
Figure 5:
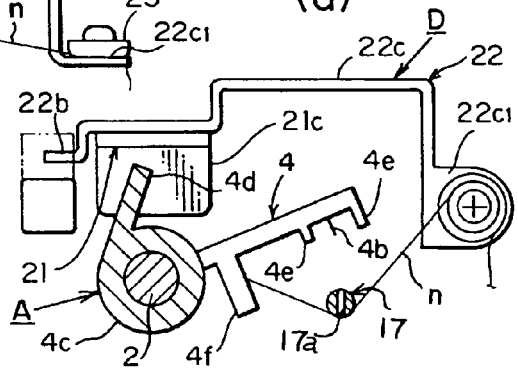

As shown in FIG. 5(*a*), the upper thread n which is guided by a thread guide 19*a* on a needle holder 19 is hanged to the thread hanger 4*f* of the threading member 4 and is then held by the thread holder 23 as extended across the needle axis on the front side of the machine needle 17. As the operating lever 11 is moved down against the force of the coil spring 5, the guide pin 3 which is in engagement with the inclined slot 9*a* of the movable guide 9 is moved down along the vertical guide groove 7 of the fixed guide member B and the threading bar 2 is, therefore, moved down. Then the protrusion 4*d* of the threading member 4 mounted to the lower end of the threading bar 2 is pressed against the horizontally flat surface 21*c* of the movable plate 21, and the movable plate 21 is moved down against the force of the tension spring 25 to the lowest position K.

Figure 6A:
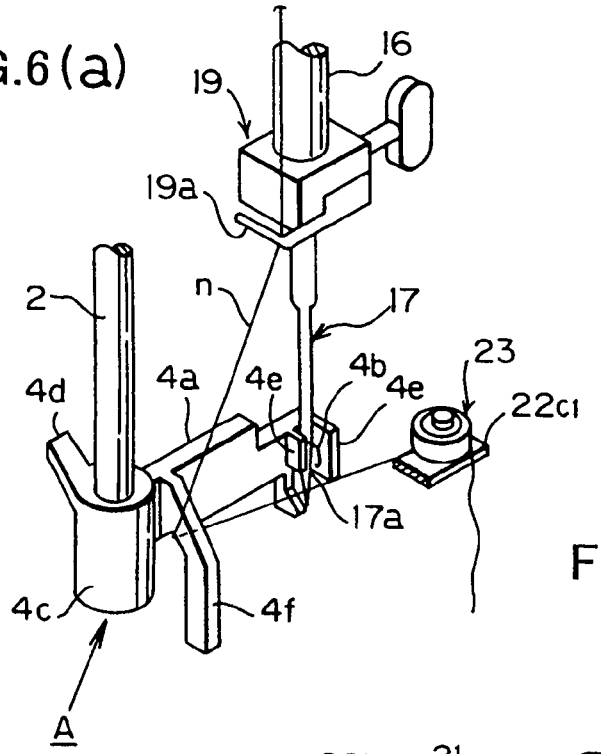
Figure 6:
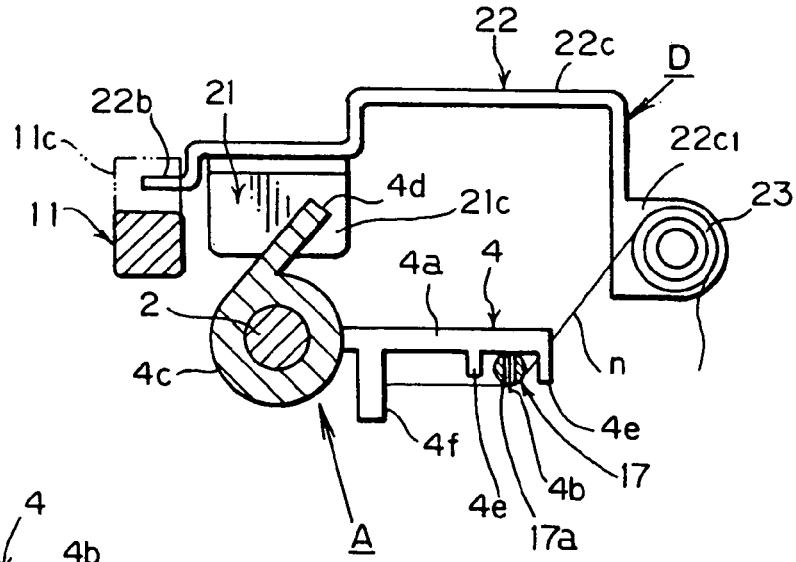
Figure 6C:
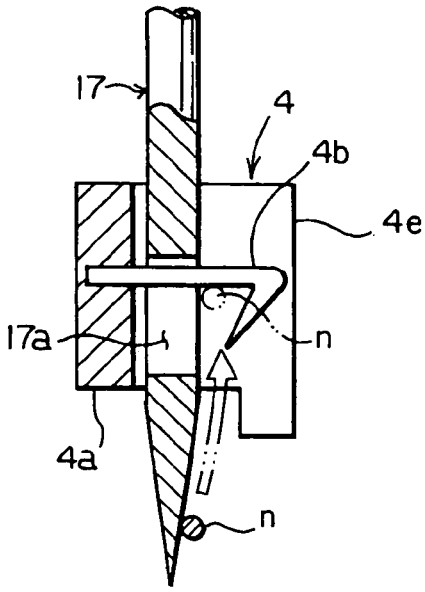
Figure 7A:
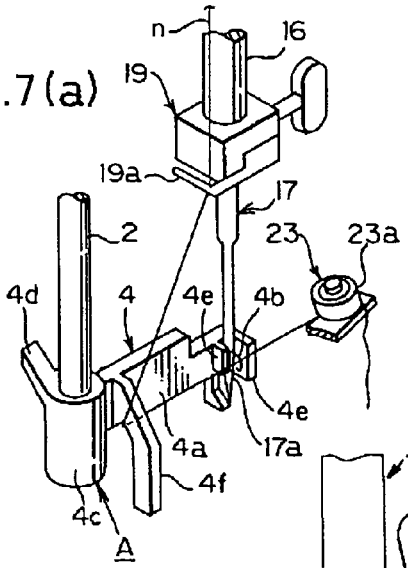
Figure 7B:
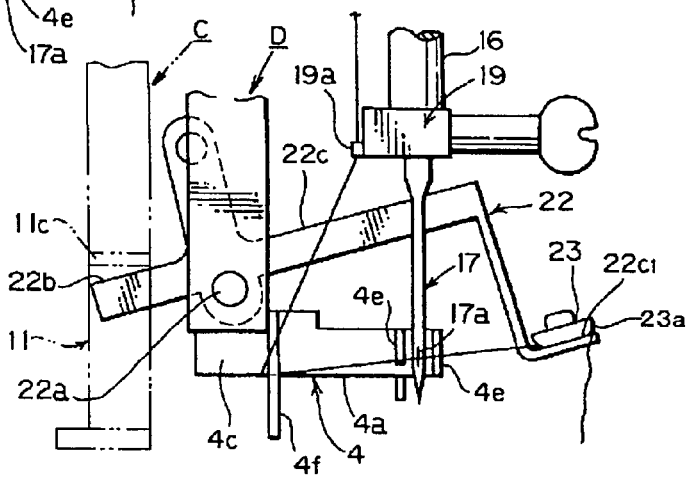
Figure 7C:
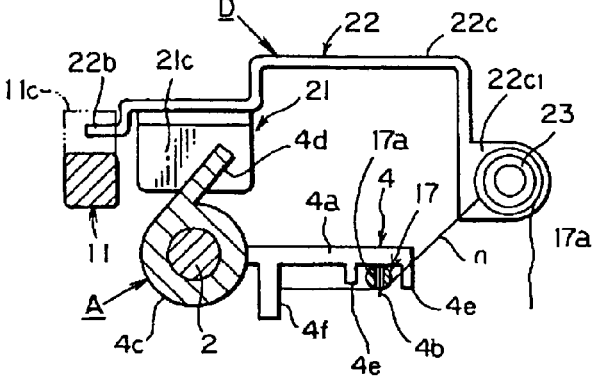
Figure 7D:
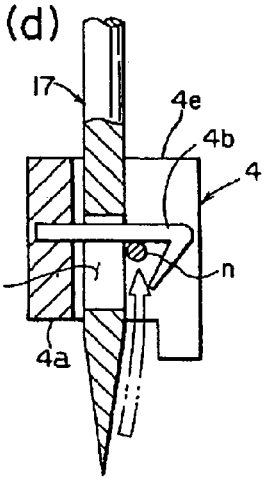

The downward movement of the guide pin 3 is stopped as the guide pin 3 comes to engage the stopper projection 13*a* of the positioning member 13, and the threading bar 2 is stopped accordingly while the threading hook 14*b* of the threading member 4 is located at a level of the eye 17*a* of the machine needle 17. In this case, the thread holding assembly 23 is located at a level that is lower than the needle eye 17*a*. As the operating lever 11 is further moved down, the threading bar 2 is axially rotated by the guide pin 3 which is in engagement with the slot 9*a* of the movable guide 9. With rotation of the threading bar 2, the arm 4*a* of the threading member 4 is rotated accordingly, and the threading hook 4*b* is passed through the needle eye 17*a* of the machine needle 17 as shown in FIGS. 6(*a*) through (*c*).

Immediately after the threading hook 4*b* is passed through the needle eye 17*a*, the lateral projection 11*c* of the operating lever 11 is pressed against the engaging part 22*b* of the thread holder 22. Then the thread holder 22 is rotated around the pivot 22*a* and the thread holding assembly 23 is jumped up axially of the machine needle 17 to the position slightly above the position of the needle eye 17*b* due to the jump up force of the toggle spring 24 which acts as a position setting means of the thread holding assembly 23 as shown in FIGS. 7(*a*) and (*b*).

Figure 8:
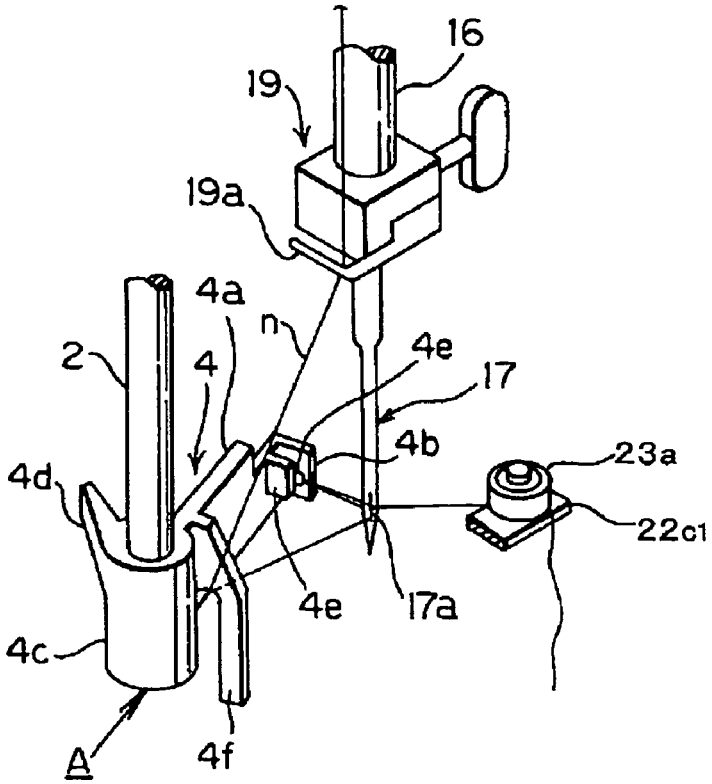
Figure 8:
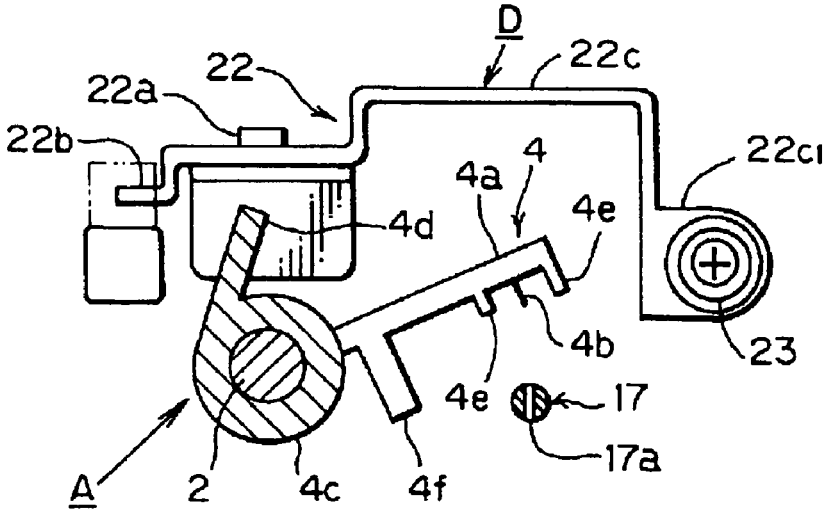

In this condition, the upper thread n is hanged to the threading hook 4*b* which is in the position as passed through the needle eye 17*b* as shown in FIGS. 7(*c*) and (*d*). Subsequently when the operating lever 11 is released, the operating lever 11 is moved up by the coil spring 5, and the threading bar 2 is moved up accordingly while the threading member 4 is rotated to retreat the threading hook 4*b* from the needle eye 17*a* as shown in FIGS. 8(*a*) and (*b*). Thus the threading operation is finished. As the threading bar 2 is moved up, the movable member 21 is released and is moved up by the tension spring 25. The thread holder 22 which is moved up with the movable member 21 is stopped by a projection or the like of the machine arm (not shown) engaging the arm 22*c* of the thread holder 22), and is rotated back to the inoperative position where the thread holding assembly 23 is located in the lower position. Incidentally in this embodiment the toggle spring 24 is used as a means for changing the position of the thread holder 22. However the toggle spring 24 may be replaced with a rotary solenoid or a spring activated link mechanism.

What is claimed is:

1. A sewing machine comprising:

a needle having a needle eye formed at the lower end thereof;

a threading hook which may be passed through said needle eye and may catch an upper thread of the sewing which is provided to be threaded through said needle eye;

a thread inserting means for inserting said threading hook through said needle eye and subsequently pulling back said threading hook from said needle eye;

a thread holding means for holding said upper thread with tension applied thereto;

a thread moving means which is operated in association with operation of said thread inserting means to move said thread holding means to a position where said upper thread may be caught by said threading hook which is inserted through said needle eye;

wherein said thread holding means holds said upper thread at a lower position with respect to said needle eye on a side thereof where said threading hook is protruded through said needle eye, said upper thread being moved up by said thread moving means in contact with the needle to a position where said upper thread may be caught by said threading hook, and said threading hook is pulled out of said needle eye while catching said upper thread held by said thread holding means.

2. The sewing machine as defined in claim 1, wherein said thread moving means is operated in association with operation of said thread inserting means for pulling said threading hook out of said needle eye, to move said upper thread to said position where said upper thread may be caught by said threading hook.

3. A sewing machine comprising:

a needle having a needle eye formed at the lower end thereof;

a threading hook which may be passed through said needle eye and may catch an upper thread of the sewing which is provided to be threaded through said needle eye;

a thread inserting means for moving down said threading hook from an upper position to pass said threading hook through said needle eye and for moving up said threading hook to the upper position while said threading hook is pulled out of said needle eye;

a thread holding means for holding said upper thread with tension applied thereto, said thread holding means being operated in association with movement of said thread inserting means and being moved down and moved up together with said threading hook;

a thread moving means for moving said upper thread held by said thread holding means to a position where said upper thread is caught by said threading hook which is passed through said needle eye, said thread moving means being operated in association with movement of said thread inserting means and being moved down and moved up together with said threading hook;

wherein said thread holding means holds said upper thread at a lower position with respect to said needle eye on a side thereof where said threading hook is protruded through said needle eye, said upper thread being moved up by said thread moving means in contact with the needle to a position where said upper thread may be caught by said threading hook, and said threading hook is pulled out of said needle eye while catching said upper thread held by said thread holding means.

4. The sewing machine as defined in claim 3, wherein said thread holding means holds said upper thread with a tension applied thereto when said thread holding means is moved down to a lower position where said upper thread is hanged to said thread holding means by a machine user.

5. The sewing machine as defined in claim 3, wherein said threading hook includes a hook opened at the underside thereof, said thread holder holds said upper thread at a position below said threading hook which is protruded through said needle eye and said thread moving means moves said thread holder such that said upper thread may be moved up along and in contact with said needle to a position where said upper thread may be caught by said threading hook.

6. The sewing machine as defined in claim 3, wherein said threading hook, said thread inserting means and said thread holder are normally urged in the upper direction by spring action and are normally held in the upper position, wherein said thread inserting means is manually operated to move down against spring action to a lower position where said threading hook is passed through said needle eye, said threading hook being pulled out of said needle eye and moved up together with said thread inserting means and said thread holder when said thread inserting means is released from said manual operation, and wherein said thread moving means moves said thread holder such that said upper thread may be moved up to a position where said upper thread may be caught by said threading hook when said thread inserting means is released from said manual operation.

7. The sewing machine as defined in claim 6, wherein said thread moving means includes a jump mechanism for jumping up said upper thread to a position where said upper thread may be caught by said threading hook.

8. The sewing machine as defined in claim 3, further comprising a support member for supporting said threading hook, said support member being vertically movable and axially rotatable, wherein said thread inserting means may be operated to move down said support member while axially rotating the same until said threading hook is rotated to pass through said needle eye, said thread inserting means subsequently rotating said support member in the opposite direction to pull out said threading hook from said needle eye and returning said threading hook to an upper position.

9. A threading device of sewing machine provided with a needle bar having a needle attached to the lower end thereof and being operated to make a vertically reciprocating movement, said needle having a needle eye formed at the lower end portion thereof; a needle bar holder which is swingable around a pivot in a direction normal to a cloth feeding direction, said needle bar holder holding said needle bar such that the latter may vertically reciprocate relative to the former; a threading bar having a thread anchoring member and a threading hook provided at the lower end thereof, said threading bar being supported on said needle bar holder such that the former may be axially movable and axially rotatable relative to the latter; a guide means for defining a first region where said threading bar is vertically guided in accordance with operation of an operating member and a second region where said threading bar is axially rotated in accordance with operation of the operating member, wherein an upper thread of sewing machine anchored to said thread anchoring member is passed through said needle eye by operation of said operating member;

said threading device of sewing machine comprising:

a movable member vertically moved due to vertical operation of said operating member;

a thread holder swingably supported on said movable member and having a threading holding assembly mounted at one end thereof for holding said upper thread which is anchored to said thread anchoring member and extended across said needle:

a position changing means provided between said movable means and said thread holder for changing the position of said thread holding assembly between a lower inoperative position where said thread holding assembly waits said upper thread to be fixed thereto and an upper operative position where said thread holding assembly holds said upper thread so as to be passed through said needle eye;

wherein with downward operation of said operating member against spring action, said threading bar is moved down to the lower end of said first region defined by said guide means where said thread holding assembly is located at a position where said upper thread is extended across said needle between said thread anchoring member and said thread holding assembly at a level below the level of said needle eye while said thread holding assembly is located in said lower inoperative position, and wherein with further downward operation of said operating member, said threading bar is axially rotated in one direction in said second region as defined by said guide means to pass said threading hook through said needle eye, said threading bar being axially rotated in the opposite direction in said second region when said operating member is moved up or released from operation thereof, said threading hook being simultaneously pulled out of said needle eye while said position changing means is activated to move said thread holding assembly to said upper operative position where said upper thread may be passed through said needle eye.

10. The threading device of sewing machine as defined in claim 9, wherein said operating member is normally urged in the upper direction by a spring means.

11. The threading device of sewing machine as defined in claim 9, wherein said position changing means includes a toggle spring arranged between said movable member and said thread holder.

* * * * *